US006470699B1

(12) United States Patent
Okuda et al.

(10) Patent No.: US 6,470,699 B1
(45) Date of Patent: Oct. 29, 2002

(54) CEILING CASSETTE TYPE AIR CONDITIONER

(75) Inventors: Kenji Okuda; Kenji Gajina, both of Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 09/937,211

(22) PCT Filed: Jan. 18, 2001

(86) PCT No.: PCT/JP01/00307

§ 371 (c)(1),
(2), (4) Date: Sep. 24, 1991

(87) PCT Pub. No.: WO01/55649

PCT Pub. Date: Aug. 2, 2001

(30) Foreign Application Priority Data

Jan. 28, 2000 (JP) ..... 2000-020227
Feb. 10, 2000 (JP) ..... 2000-033785

(51) Int. Cl.[7] ..... A25D 23/12

(52) U.S. Cl. ..... 62/259.2; 62/DIG. 16

(58) Field of Search ..... 62/259.2, 404, 62/407, 418, DIG. 16; 165/53, 54

(56) References Cited

FOREIGN PATENT DOCUMENTS

| | | |
|---|---|---|
| GB | 2 314 924 | 1/1998 |
| JP | 2639223 | 8/1992 |
| JP | 2998630 | 9/1997 |

*Primary Examiner*—Chen-Wen Jiang
(74) *Attorney, Agent, or Firm*—Pillsbury Winthrop LLP

(57) ABSTRACT

A ceiling cassette type air conditioner includes a housing adapted for attachment to a room ceiling panel, a bell-mouth provided in the housing and having a bottom opening and an outer circumferential surface. An electrical part box is provided in the housing to accommodate electrical components. The electrical part box is arranged near that side of the bell-mouth at which secondary air flows. The electrical parts are mounted on a control board provided in the electrical part box. The electrical parts are arranged so that those which are located near the outer circumferential surface of the bell-mouth are less tall than the others.

12 Claims, 11 Drawing Sheets

CEILING CASSETTE TYPE AIR CONDITIONER

This application is the National Phase of International Application PCT/JP01/00307 filed Jan. 18, 2001 which designated the U.S. and that International Application was published under PCT Article 21(2)in English.

TECHNICAL FIELD

The present invention is concerned with ceiling cassette type air conditioner mounted to the ceiling of the room to be air conditioned, and in particular, it relates to the improvement of the mounting of temperature sensor that detects the temperature of the room air which is sucked in and guided by the bell-mouth, and the improvement of the arrangement of electrical parts box versus the bell-mouth as well as the mounting structure of the electrical parts in the electrical parts box.

BACKGROUND ART

The ceiling cassette type air conditioner comprises an enclosure which is open at the bottom, a blower located at approximately the center of this enclosure, heat exchangers arranged around the blower, a bell-mouth that is installed so that its upper opening portion is facing the axial direction of the blower, and a decorative panel exposed to the room to be air conditioned from the ceiling surface, and which possesses a suction inlet facing the bottom opening portion of the bell-mouth, and which possesses blower outlets around the suction inlet, and blocks the lower opening portion of the enclosure.

Therefore, only the decorative panel that possesses the suction inlet and the blower outlet is exposed from the ceiling panels, that is, the enclosures of the ceiling cassette type air conditioners are embedded above the ceiling panels of the room to be air conditioned, and the inhabitants do not receive the sense of oppression at all, so there is a tendency of their usage increasing.

In such an air conditioner is equipped with electrical parts that control motor-driven parts such as a blower, and electrical parts that receive detection signals such as remote controller (remote control operating panel) as well as operation instruction signals transmitted from various detection means, and change them into control signals.

The electrical parts consist of many electric parts and electronic parts, and because of the limited space in the enclosure, the electric parts are attached to a single control board, and after making electrical connections, they are accommodated in an electrical parts box.

Furthermore, inside of the enclosure, heat exchangers, a drain pan to receive the drain water generated from the heat exchangers, a blower to blow the room air through the heat exchangers, and a bell mouth to guide the room air smoothly to the blower are arranged.

Hitherto, there were problems related to arrangement of electrical parts box against the aforementioned bell-mouth and mounting structure of the electrical parts that are accommodated in the electrical parts box.

In other words, as electrical parts accommodated in the electrical parts box, there are all kinds of parts, for instance, small-sized electronic parts such as integrated circuits, resistances, and FET, a rather big-sized large capacity condenser, and medium-sized parts such as switching transformer, small capacity condenser, noise filter, etc. All of these parts are mounted to a single board for the convenience of circuit designing. As a result, the total height dimension of the electrical parts box uses the control board as the basis, and for instance, the big-sized electrical parts such as the large capacity condenser, are accommodated with dimensions having allowance. As a result, the electrical parts-box becomes big-sized, and it hinders the miniaturization of the unit.

In addition, for instance, as shown in FIG. 16A, the bell-mouth Ba originally has a tapered shape (cone-shaped) cross section, that is, small diameter at the top opening, and large diameter at the bottom opening, but in order to mount the electrical parts box D, a part of the tapered surface is bent back to the upper side, then bent horizontally. The electrical parts box D is mounted to the passage side of the primary air (air which is sucked in) at the lower portion of the bell-mouth horizontal plane. In the drawing S stands for the control board and E stands for the electrical parts mounted to the control board S.

On the other hand, as shown in FIG. 16B, bell-mouth Bb has a part of the tapered portion bent down vertically, then bent horizontally. The electrical parts box D is mounted above the horizontal plane of the bell-mouth on the passage side of the secondary air.

In this way, whether it is bell-mouth Ba or Bb, in order to mount the electrical parts box D, a part of the bell-mouth has to be deformed, and consequently, the bell-mouth does not take an ideal form, thereby hindering the blower performance.

On the other hand, the air conditioner, in order to conduct the pre-set air conditioning, one of the control conditions is to measure the present room temperature. This is possible by detecting the temperature of the air of the room to be air conditioned by a temperature sensor when the air is sucked in and guided by the bell-mouth, and transmitting these detection signals to the controller among the electrical parts.

As an actual temperature sensor mounting structure, a sensor supporting member is mounted to the inner surface side of the suction air guide side of the bell-mouth, and the sensor is supported by this supporter. The temperature sensor must be electrically connected with a controller which composes one of the electrical parts, but these electrical parts can secure arranging space only above the bell-mouth.

As a result, a lead wire of which one end is connected to the controller is extended from the upper part of the bell-mouth to the periphery of the sensor, then further stretched to the inner surface side of the bell-mouth. Furthermore, the other end must be connected to the temperature sensor that is supported by the sensor-supporting member. In conclusion, the total length of the lead wire becomes very long, and it has bad influence on the cost.

Not only the cost, but also at the time of maintenance when it becomes necessary to remove the bell-mouth, the sensor supporting member will have to be removed from the bell-mouth together with the temperature sensor. Furthermore, after the maintenance work is completed, the lead wire will have to be extended and connection will have to be made. Thus, there were problems such as being time-consuming, and having bad maintenance operation efficiency.

DISCLOSURE OF INVENTION

The first objective of the present invention is to obtain a bell-mouth shape having excellent blower characteristics, and to mount the electrical parts into the electrical parts box without interfering with the shape of the bell-mouth, thereby providing a ceiling cassette type air conditioner which can be designed compactly.

The present invention comprises a housing provided on the ceiling panel of a room and having a bottom opening, a heat exchanger arranged in the housing; a drain pan provided in the housing, a blower provided in the housing, a bell-mouth provided in the housing and having a bottom opening and an outer circumferential surface, an electrical part box provided in the housing and accommodating electrical part; and a decorative panel closing the bottom opening of the housing, having an inlet port opposing the bottom opening of the bell-mouth and having outlet ports surrounding the inlet port, wherein the electrical part box is arranged near that side of the bell-mouth at which secondary air flows, the electrical parts are mounted on a control board provided in the electrical part box, and those of the electrical parts which are located near the outer circumferential surface of the bell-mouth are less tall than the other electrical parts.

According to the present invention, it is possible to set the bell-mouth in a shape having excellent blowing characteristics, and without interfering such bell-mouth shape, the electrical parts inside of the electrical parts box are mounted, and this has an effect of making the unit compact.

The second objective of the present invention is to shorten the length of lead wire when mounting the temperature sensor, and at the same time, omit the extending-around operation. In addition, it aims at providing a ceiling cassette type air conditioner in which the maintenance workability can be improved.

In the present invention, at approximately the center of the open-bottom enclosure that is mounted to the ceiling, a blower is mounted, and heat exchangers are arranged around the blower. The upper opening portion of the bell-mouth is mounted so that it faces the suction side or axial direction of the blower and blocks the lower opening of the enclosure, and facing the lower opening of the bell-mouth, a decorative panel equipped with a suction inlet and blower outlets surrounding the suction inlet is installed so that the decorative panel is exposed at the ceiling level of the room to be air-conditioned. Immediately above the bell-mouth, the electrical parts such as the controller is mounted, and a through-hole is made in the bell-mouth at a position close to the electrical parts, and a temperature sensor is inserted into the through hole so that it protrudes into the room air suction side, and among the electrical parts, the sensor is connected electrically to the controller with lead wires, and made to detect the temperature of the room air.

According to the present invention, with a very simple structure of providing a through-hole portion in the bell-mouth in order to insert a temperature sensor through it, the lead wire connecting the temperature sensor and the controller of the electrical parts can be shortened, and the temperature of the air of the room to be air conditioned can be detected accurately, and detection accuracy can be secured. In case of maintenance work where it is necessary to remove the bell-mouth, the temperature sensor can be left as it is, and it will suffice by merely pulling off the through-hole portion of the bell-mouth. In addition, it is not necessary to conduct temperature sensor attachment work after the maintenance work.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

BEST MODE FOR CARRYING OUT OF THE INVENTION

The embodiments of the invention will be described with reference to the accompanying drawings.

Figure 1:
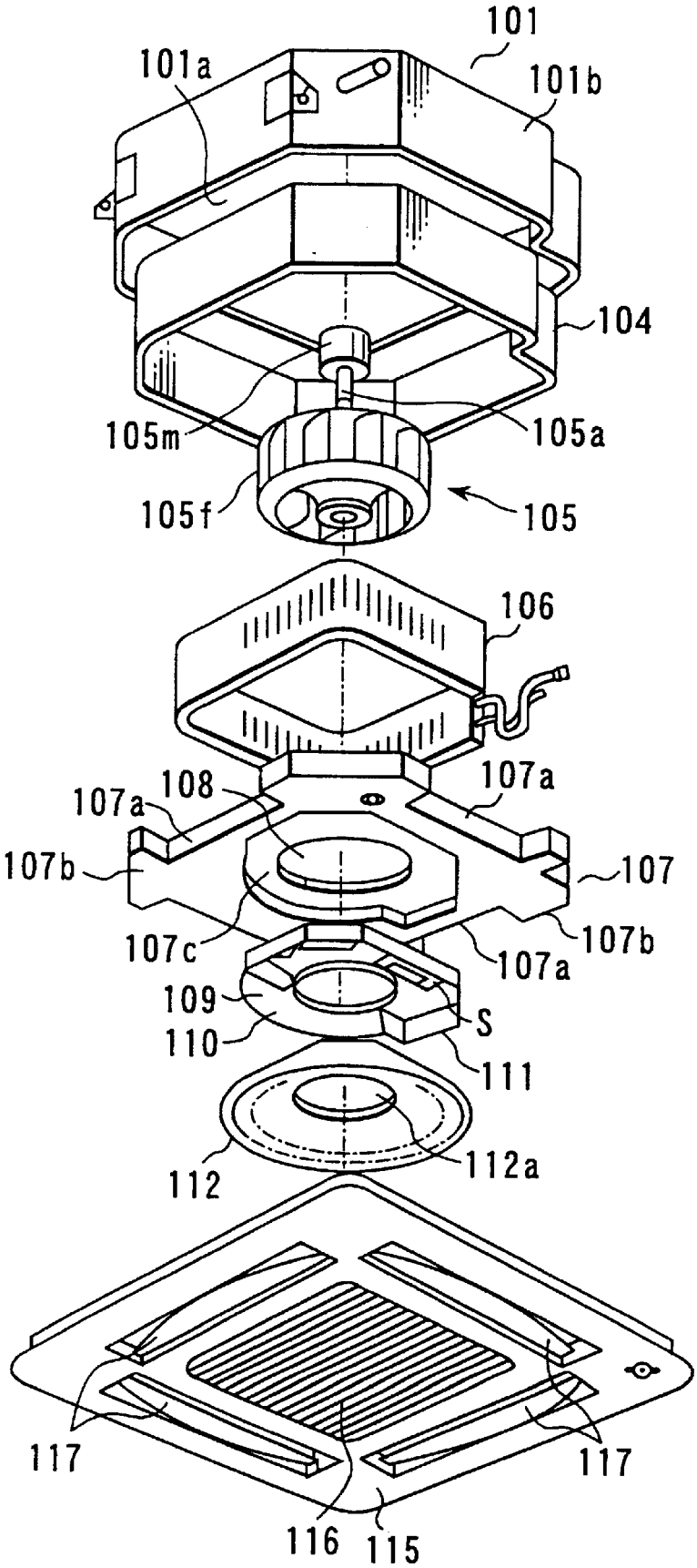
FIG. 1 is related to the first embodiment of the present invention and it shows a perspective drawing of the same ceiling cassette air conditioner in a disassembled state.
Figure 2:
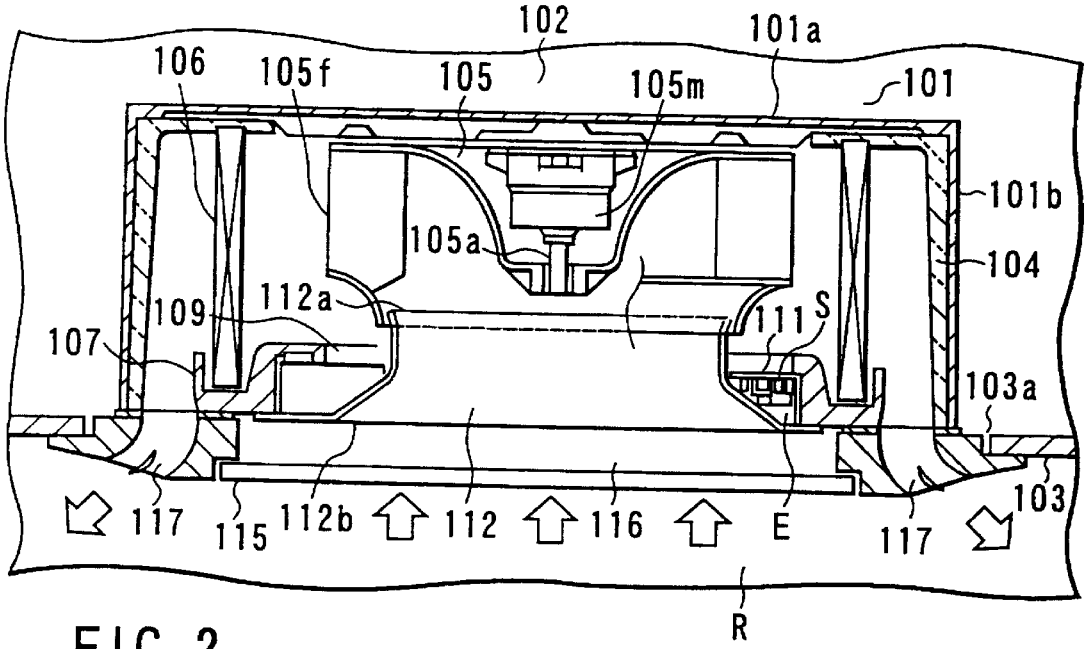
FIG. 2 is a cross-section of the same ceiling cassette type air conditioner.

FIG. 1 is a perspective drawing that shows the disassembled ceiling cassette type air conditioner related to the first embodiment of the present invention, and FIG. 2 is a cross section drawing showing the assembled and operating ceiling cassette type air conditioner.

In the drawing, 101 stands for an enclosure, and this enclosure 101 is a rectangle in the plan view, the top piece 101*a* is made into an octagonal shape with the four corners missing, and the side walls 101*b* are made by integrating a side wall along each side of the top plate 101*a*.

The enclosure 101 is hung and fixed from the loft 102 buy a suitable means, and the bottom opening portion is made to face the opening portion 103*a* made in the ceiling panel. The respective inner surfaces of the top plate 101*a* and a part of the side walls 101*b* have thermal insulating materials 104 closely attached to them.

To the center portion inner surface of the enclosure top plate 101*a,* a fan motor 105*m* that composes the blower 105 is mounted and fixed. The axial direction of this fan motor 105*m* is set in the vertical direction, and to the revolving shaft 105*a* protruding downwards, the fan 105*f* is fitted. When the aforementioned fan 105*f* is driven and revolved by the fan motor 105*m,* it will suck in air from the bottom side in the axial direction, and conduct blower action by blowing air out in the circumferential direction. In addition, centered around the blower 105, heat exchangers 106 are arranged. These heat exchangers 106 are connected with piping to the outdoor unit (not illustrated) such as the outdoor compressor and outdoor heat exchangers that are arranged to compose a refrigerating cycle.

The aforementioned heat exchangers are rectangular shaped in the plan view, and are located in a position where they receive the air blown from the blower fan 105. The heat exchangers 106 are placed on the receiving portion of the drain pan that is engaged to the bottom opening portion of the enclosure 101 via thermal insulating material 104, and they are supported between this drain pan 107 and the enclosure top plate 101*a* via thermal insulating materials 104. In other words, the top surface-of the heat exchangers 106 is in close contact with the enclosure top plate 101*a* via thermal insulating material, and the bottom surface of the heat exchanger 106 is in close contact with the drain pan 107.

The drain pan 107 has each side concavely formed, and gaps exist between the enclosure side walls 101*b*. Practically, only the corner portions 107*b* are engaged with the corner portions of the enclosure side-walls 101*b* via thermal insulating materials 104. Because of this, the air that has passed through the heat exchangers 106 is guided to the concavely formed portions 107*a* of the drain pan 107.

Furthermore, the drain pan 107 is bent and formed into an approximately U-shaped cross-section at the same height as the upper edges of the concavely formed portion 107*a* and the corner portion 107*b,* and at the bottom portion the aforementioned heat exchangers 106 are arranged. A plate portion 107*c* is made for the whole circumference of the inside bent-upper edge, and at the center of the plate portion 107*c,* a round opening portion 108 is made with the specified diameter. To the plate portion 107*c* that composes the drain pan 107, a supporting panel 109 having identical shape dimensions as the plate portion is engaged, and fixed in place by a suitable means. In the center of the supporting panel 109, an opening portion 110 having identical dimensions as the opening portion 108 made in the plate portion 107*c* is provided. In addition, the electrical parts box 111 mentioned later on is mounted to this side portion.

Via such opening portion 108 of plate portion 107*c* and opening portion 110 of the supporting panel 109, in a very close position to the-fan 105*f* of the blower 105, the top opening portion 112*a* of the bell-mouth 112 is arranged so as to face it. This bell-mouth 112 will also be described later on.

The bottom opening portion of the enclosure 101 is blocked by a decorative panel 115 that has a rectangular shape in the plan view. This decorative panel 115 is in a position to be exposed from the ceiling panel 103 in the room R to be air-conditioned, and in the center, a rectangular suction inlet 116 is made, and in the peripheral portion, a plurality of narrow rectangular shaped blowing outlets 117 is opened.

Furthermore, if further explanation is given, the suction inlet 116 of the decorative panel 115 is mounted so that it faces lower opening portion 112*b* of the bell-mouth 112. Thus, by the action of the blower 105, the room air sucked in from the suction inlet 116 is led to the bottom opening portion 112*b* of the bell-mouth 112 as primary side air. In addition, it is guided by the bell-mouth 112, and from the upper opening portion 112 it is guided to the blower fan 105*f*.

On the other hand, each blowing outlet 117 is facing the concavely formed portion of the drain pan 107*a,* and the air that passes through the heat exchanger 106 is led to the blower outlet 117 via the concavely formed portion 107*a,* and from here it is guided so that it is blown into the room-R to be air-conditioned.

Furthermore, the electrical parts box 111 is mounted to the supporting panel 109 provided to the outer side of the bell-mouth 112. Thus, it will be arranged on the side where the secondary air of the bell-mouth passes.

Figure 3:
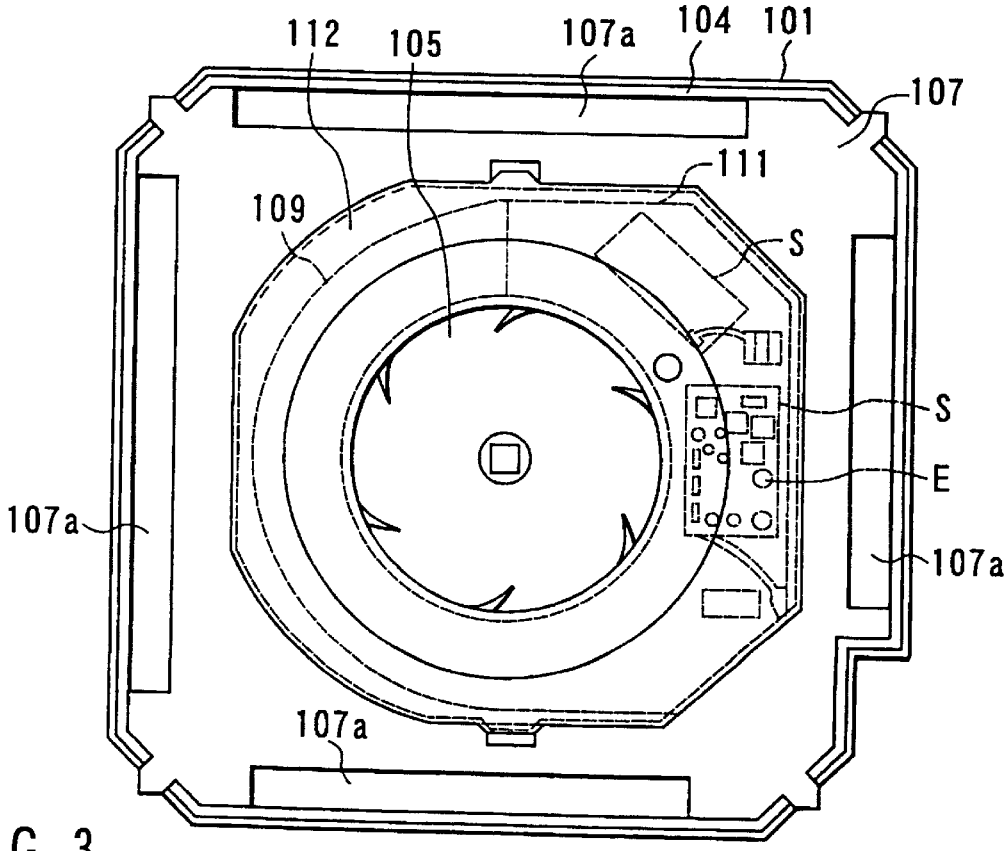
FIG. 3 is a bottom view of the same ceiling cassette air conditioner in a state in which the decorative panel is removed.

FIG. 3 shows the assembled ceiling cassette type air conditioner, and in addition, it shows the inside state of an enclosure 101 when looked up from the bottom (i.e. when seen from the room side) after the aforementioned decorative panel 115 is removed. At the center portion, a part of the blower fan 105 can be seen, and in its periphery, the bell-mouth 112 can be seen. Furthermore, in the periphery of the bell-mouth 112, there is the drain pan 107, and at the four sides, the concavely formed portions 107*a* that become the passage of the blowing air can be seen. The whole periphery of the drain pan 107 is surrounded by the thermal insulation material 104 and the enclosure 101.

A pair of electrical parts boxes 111 shown by broken lines are shielded by the bell-mouth 112, and actually they cannot be seen. The electrical parts boxes 111 have a rectangular shaped plan view, and at mutually adjacent positions, they are arranged so that they maintain a specified angle versus the shaft center of the bell-mouth 112.

Figure 4A:
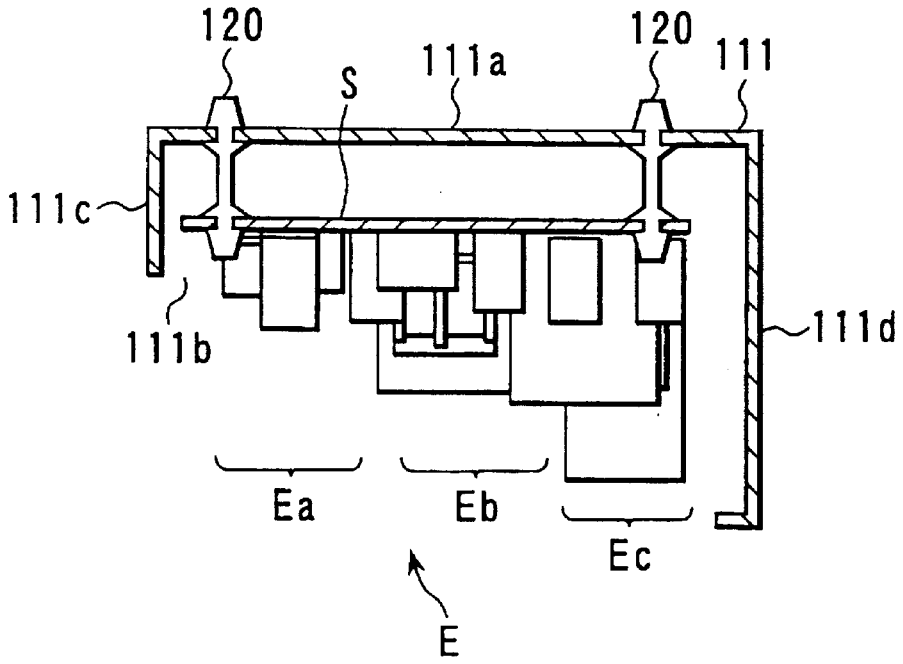
FIG. 4A is a cross-section view of the electrical parts box that accommodates the electrical parts mounted to the control board built into the same ceiling cassette type air conditioner.
Figure 4B:
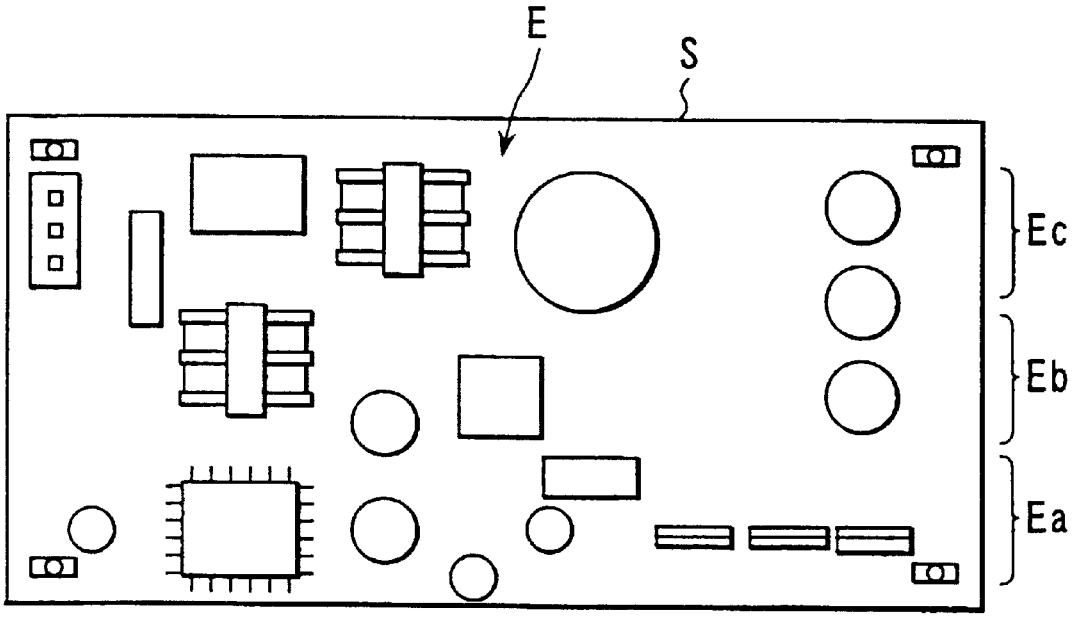
FIG. 4B is a plan view of control board that mounts the electrical parts built into the same ceiling cassette type air conditioner.

FIG. 4A shows a cross-section drawing of the electrical parts E that are mounted to the control board S and the electrical parts box 111 that accommodates these control boards and electrical parts E, and FIG. 4B shows the plan view of the mounting positions for the electrical parts E versus the control board S.

As an electrical parts box 111, against the horizontal top plate 111*a,* the bottom side opening portion 111*b* is formed, and in addition, the height dimension of the side walls 111*c* on one side is made small, and the height dimension of the side walls of opposing side 111*d* is made to be larger.

The control board S is formed so that the width will be slightly narrower than the distance between the side walls 111*c* and 111*d* of the electrical parts box 111, and a very narrow gap exists between the electrical parts box top plate 111*a,* and they are suspended by the fixtures 120 so that they will be parallel.

In the present invention, one of the characteristics is the mounting structure of the electrical parts E versus the electrical parts box 111. In other words, near the side of the side-walls having smaller height dimensions of the electrical parts box 111, the electrical parts group Ea having the lowest height dimension is mounted. Then electrical parts groups Ec are mounted in the order of the height dimensions in the direction of the side-walls 111*d* that has a large height dimension.

Concretely speaking, the electrical parts E are classified into three groups, namely, electrical parts group Ea having the lowest height dimensions, electrical parts group Eb having medium height dimensions, and electrical parts group having the highest height dimension. These parts are arranged in the order of the height on the control board from one end of the short side-wall side to the other side.

If we express the group of electrical parts with the lowest height as Ea, it includes such parts as integrated circuits, resisters, and FET. If we express the group of electrical parts with the medium height as Eb, it includes parts such as switching transformer, small capacity condensers, and noise filters. If we express the group of electrical parts with the highest height as Ec, it includes large capacity condensers and noise filters.

In this way, control board S to which electrical parts E are mounted are accommodated into the electrical parts box 111, but as mentioned above, to the side-wall side of the electrical parts box 111 having small height dimension 111*c,* the electrical parts group Ea having the lowest height is made to face them, and to the electrical parts box 111 having the highest side-wall 111*d,* the electrical parts group Ec having the highest height is made to face them when accommodated.

Figure 5A:
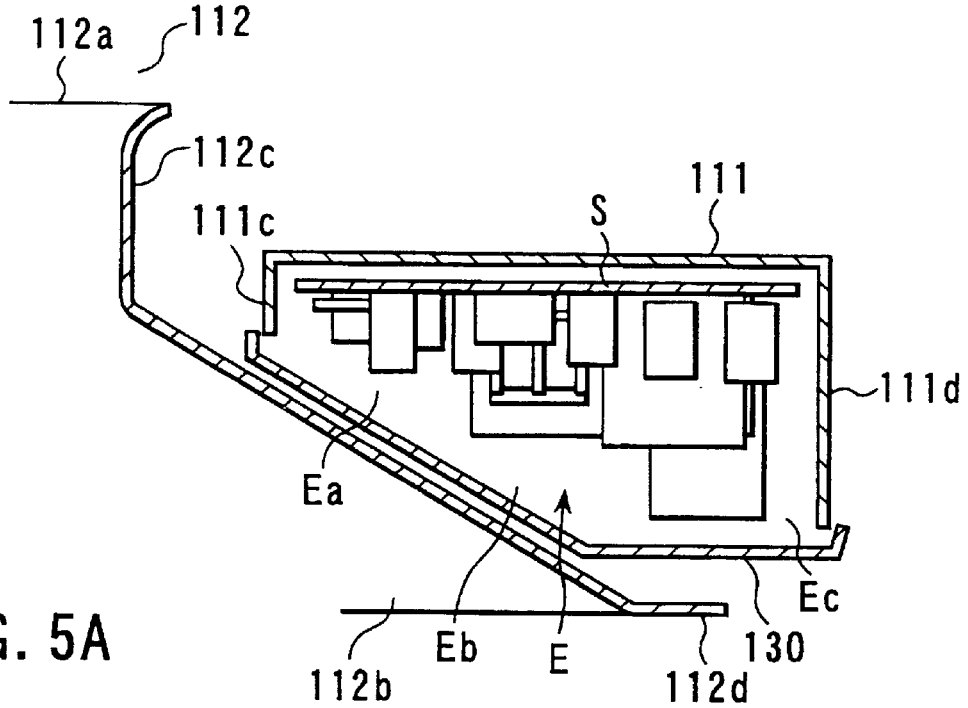
FIGS. 5A and 5B are cross-section views that explain the relative relation between the bell mouth and the electrical parts box which are built into the same ceiling cassette type air conditioner, and which have mutually different shapes.

In FIG. 5A and after, position setting of the electrical parts box versus the bell-mouth 112 and the mounting structure of the electrical parts are described concretely. In other words, in FIG. 5A from the upper opening portion 112*a* to a specified distance downwards, it is designed straight, and below this straight portion 112*c* to the bottom opening portion 112*b,* it is designed with a taper (This is also referred to as conical-shaped or bell rim shape of a bugle), and the case in which bell mouth 112 is adopted is shown.

If we repeat our description, in case the room air suction-guide side of bell-mouth 112 is referred to as the primary side, and the blowing side is referred to as the secondary side, since the electrical parts box 111 is located at the upper side of the bell-mouth 112, it will be arranged on the secondary air passage side.

The side-wall 111*c* of the electrical parts box 111 having small height dimension is arranged to face near the peripheral of the straight portion 112*c* of the bell-mouth 112, and the side-wall 111*d* of the electrical parts box having large height dimension is arranged to protrude outwards from the peripheral portion 112*d* formed along the periphery of the bottom opening portion 112*b* of the bell-mouth.

Because of the above, in the case of the electrical parts E that is mounted to the control board and accommodated inside of the electrical parts box 111, the electrical parts group Ea having small height dimension is located on the side of straight portion 112*c* of the bell-mouth 112, and the electrical parts group Ec having large height dimension will protrude from the peripheral portion 112*d* of the bell-mouth, and the changes in height dimensions almost perfectly coincide with the tapered shape of the bell-mouth 112.

The bottom opening portion 111*b* of the electrical parts box 111 is closed by the covering plate 130, and made into a closed structure. In other words, the cross-section shape of the covering plate is almost the same as the taper shape of the bell-mouth 112.

By the existence of the above mentioned covering plate, entrance of dust and water droplets into the electrical parts box 111 can be completely obstructed on one hand, and on the other hand, bad influence of the heat received by the bell-mouth by the heat dissipation of the electrical parts E can be prevented.

Figure 5B:
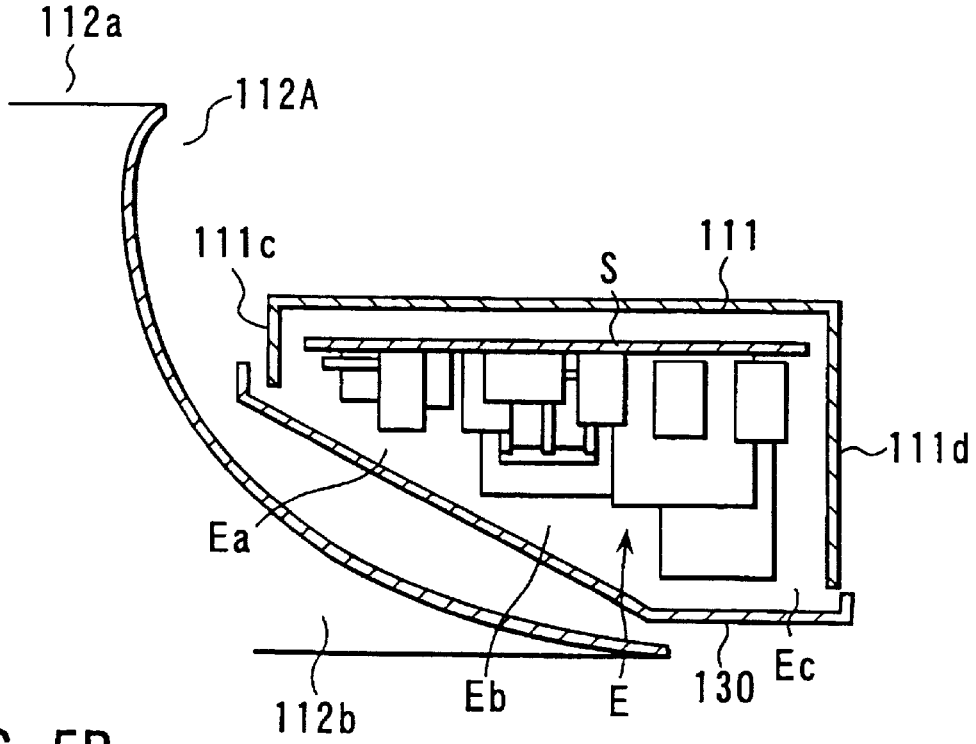

FIG. 5B shows the case in which the bell mouth cross-section has a top opening portion 112A side that is contracted into a small diameter, then curved to the bottom opening portion 112*b* side. The existence of electrical parts box 111, the fact that the control board S and the electrical parts E are accommodated in it, and the mounting structure of the electrical parts E versus the electrical parts box 111 are exactly the same as the explanation made for FIG. 5A. Therefore, the changes in the height dimension of the electrical parts E is almost the same as the cross-section shape of the bell-mouth 112.

In the above manner, this is a ceiling cassette type air conditioner that arranges electrical parts box 111 accommodating electrical parts E against bell-mouth 112 and 112A, and by starting the refrigerating cycle operation in the heat exchanger 106 and driving the blower 105, the air of the room R to be air-conditioned will be sucked in from the suction inlet 116 of the decorative panel 115, then guided by the bell-mouth 112 to the blower 105 then blown to the heat exchanger 106.

At the time the air passes through the heat exchanger 106, heat exchange is conducted, and subsequently, via the concavely formed portion 107*a* of the drain pan 107, the air reaches the blowing outlet 117, and further blown to the room R and conducts air-conditioning. The drain pan 107 receives the drain that is generated at the time of heat exchange action in the heat exchanger 106, and after collecting the drain once, it is drained outdoors via a drain hose. Even if either bell-mouth 112 or 112A explained in FIGS. 5A and 5B is used, an ideal cross-section for the bell-mouth can be obtained regardless of the arranging of electrical parts box 111. Therefore, the physical interference of the electrical parts box 111 no longer exists. Since there is no air passage resistance, a bell-mouth shape having excellent blower characteristics can be set, and furthermore, improvement in air-conditioning capacity can be aimed at. In addition, electrical parts E can be mounted without interfering with the shape of the bell-mouth, and it means that the height dimension of the enclosure 101 can be reduced and the air-conditioning unit itself can be made more compact.

Figure 6A:
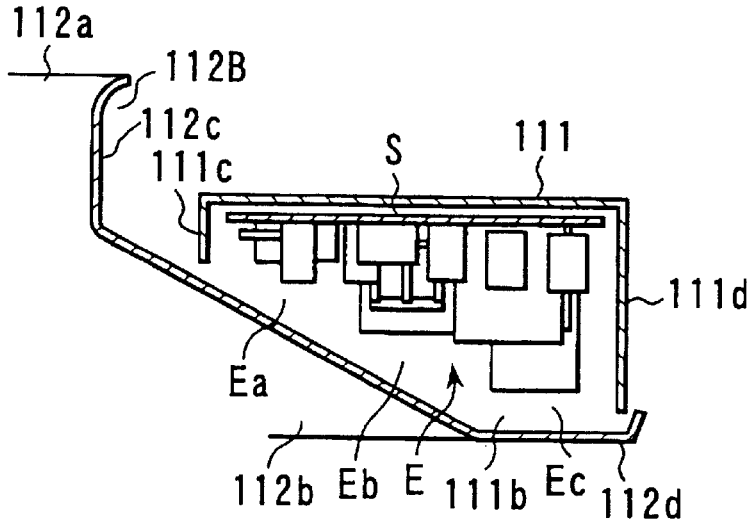
FIGS. 6A–6C are cross-section drawings that explain the relative relation between the bell-mouth and the electrical parts box which are built into the same ceiling cassette type air conditioner, and which have mutually different cross-sectional shapes.
Figure 6B:
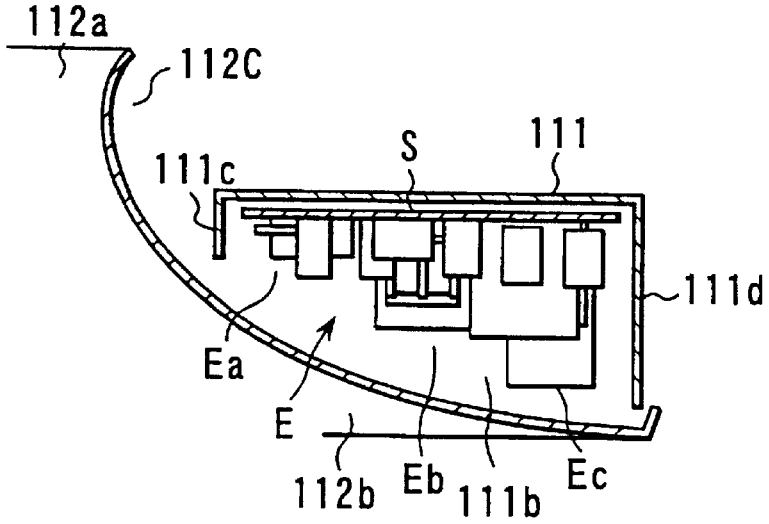
Figure 6C:
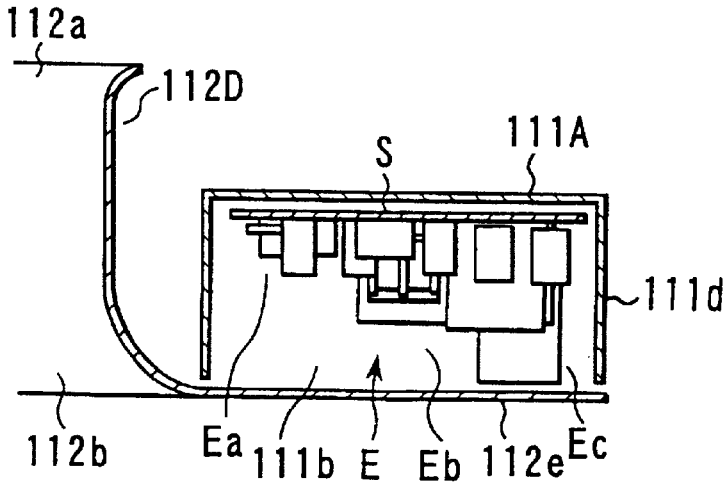

This may also take structures shown in FIGS. 6A–6C. In the case of bell-mouth 112B shown in FIG. 6A, at least one part of the peripheral portion 112*d* formed along the periphery of the bottom opening portion 112*b* is made to protrude slightly towards the outside in comparison with the large height dimension side-wall 111*d* of the electrical parts box 111, and is bent upwards.

The bell-mouth 112C shown in FIG. 6B has a curved cross-section shape from the top opening portion 112*a* to the bottom opening portion 112*b,* and at least one part of the peripheral portion for the bottom opening portion is made to protrude slightly towards the outside in comparison with the large height dimension side-wall 111*d* of the electrical parts box 111, and is bent upwards.

The bell-mouth 112D shown in FIG. 6C has a cross-section shape that is almost straight from the top opening portion 112*a* to the bottom opening portion 112*b,* and near the bottom opening portion the diameter is enlarged. After peripheral portion 112*e* formed along the bottom opening portion 112*b* secures sufficient width dimension, at least one part is extended to approximately the same length as the side-wall hid of the electrical parts box 111.

Although the cross section varies slightly, any one of the bell-mouths 112B, 112C, and 112D is basically set to excellent cross-sectional shape, and this is the same as explained earlier.

The cross-sectional shapes of the electrical parts box 111 shown in FIGS. 6A and 6B are the same as those explained earlier in FIGS. 5A and 5B. The cross-sectional shape of the electrical parts box 111 shown in FIG. 6C has the same height for the whole periphery by matching the cross-sectional shape of the bell-mouth 112D.

In any case, the mounting structure of electrical parts E accommodated in the electrical parts box 111 and 111A is as earlier explained in FIGS. 4A and 4B, and the relative positions that are taken with bell-mouths 112B, 112C, and 112D remain the same.

Here, as the material for bell-mouths 112B, 112C, and 112D, it is characteristic that flame retardant synthetic resins or metals be selected, and furthermore, the edge of the bottom opening portion 111*b* of the electrical parts box 111, 111A are placed in close contact with the outer surface of the bell-mouths 112B, 112C, and 112D and the bottom opening portion of the box is closed.

Therefore, since the mounting structure of the electrical parts E is limited, the blower characteristics of the bell-mouths 112B, 112C, and 112D are improved, and at the same time, since the aforementioned bell-mouths also act as the covering plate, the number of parts can be reduced. As a result, the height of the enclosure can be reduced that much and the unit can be made more compact.

In addition, by selecting the material of bell-mouth 112B, 112C, and 112D, even if specific electrical parts generate extremely large heat, the bell-mouth will not receive such thermal influence, and even if there is no covering plate accident prevention such as heat deformation is possible.

Figure 7A:
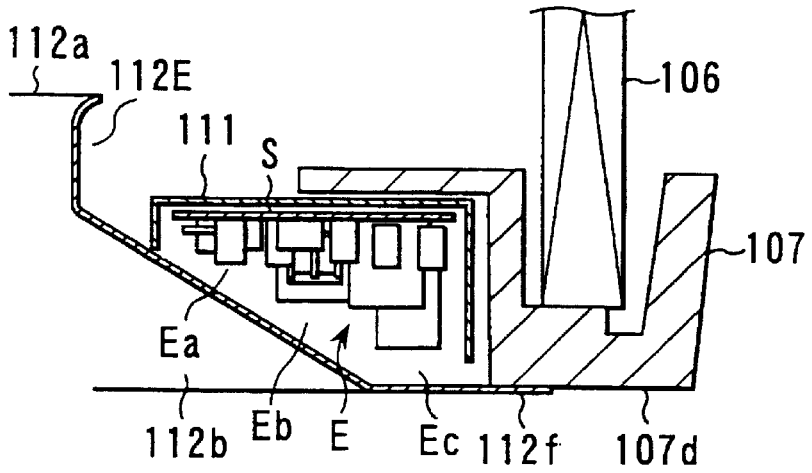
FIGS. 7A–7C are cross-section drawings that explain the relative relations among the bell-mouth, the electrical parts box, and the drain pan which are built into the same ceiling cassette type air conditioner
Figure 7B:
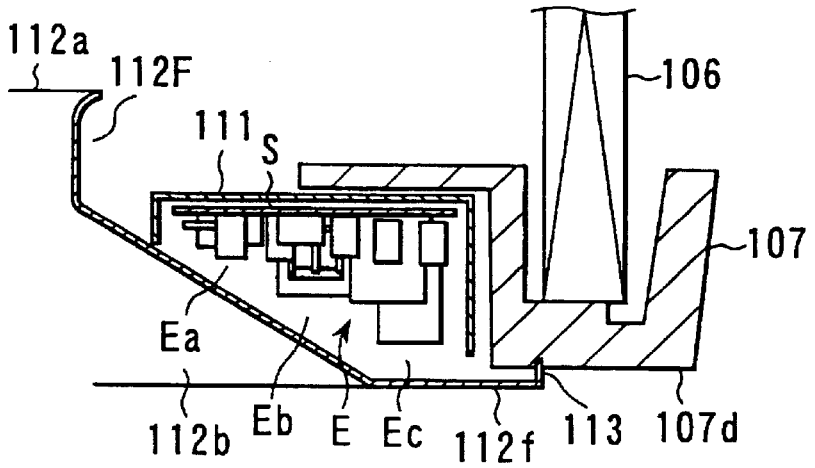
Figure 7C:
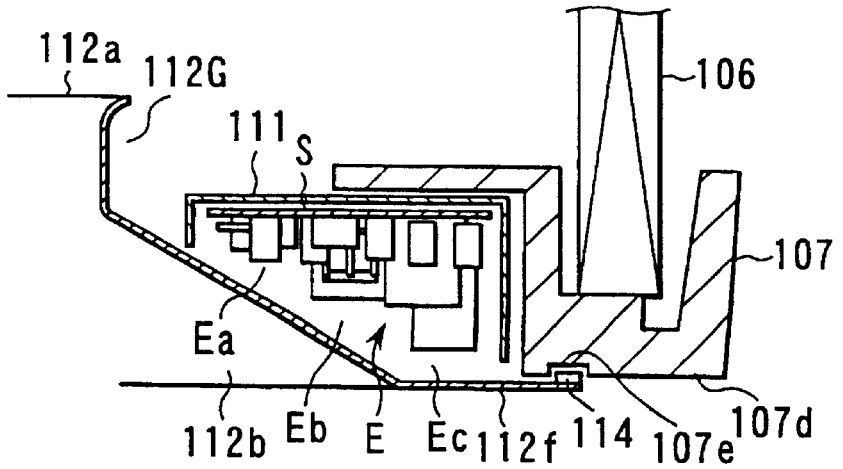

Bell-mouth structure shown in FIGS. 7A–7C may also be used. In other words, Bell-mouth 112E shown by FIG. 7A elongates the periphery portion 112*f* formed along the periphery of the bottom opening portion 112*b* more outwards than the electrical parts box 111 and makes the extended portion, and the top surface of this extended portion 112*f* comes into close contact with the bottom portion 107*d* of the drain pan 107.

Bell-mouth 112F shown in FIG. 7B has the edge of the extended portion 112*f* bent upwards to form a rib 113, and the gap between the bottom surface 107*d* of the drain pan 107 that comes into contact with the tip of the rib 113 is made minus.

Bell-mouth 112G shown in FIG. 7C has a seal member 114 attached to the end of the extended portion 112*f,* and this seal member 114 is engaged with the concave portion 107*e* made at the bottom portion of the drain pan 107*d.*

In any case, the mounting structure of the electrical parts E accommodated in the electrical parts box 111 is as previously explained in FIGS. 4A and 4B, and the relative positions of bell-mouths 112E, 112F, and 112G remain unchanged. Thus, similar results are obtained.

In any of the bell-mouths 112E, 112F, and 112G, since the edge of the extended portion 112*f* was made to come into close contact with the bottom portion 107*d* of the drain pan 107, it possesses the function of accurately shielding the primary air and secondary air of the bell-mouth at this contact portion, and even greater improvement in the blower characteristics can be aimed at.

In particular, since the bell-mouth 112F shown in FIG. 7B has the rib 113 integrated to the edge of the extended portion 112*f,* the dimensional accuracy and the mechanical strength of the bell-mouth periphery have been improved, and by making minus contact with the bottom portion 107*d* of the drain pan, a pressing force generates in the bell-mouth and the shielding function of primary air and secondary air improves all the more, and the minute gaps formed at the time of assembly are absorbed, and the blower characteristics are further stabilized.

Figure 8A:
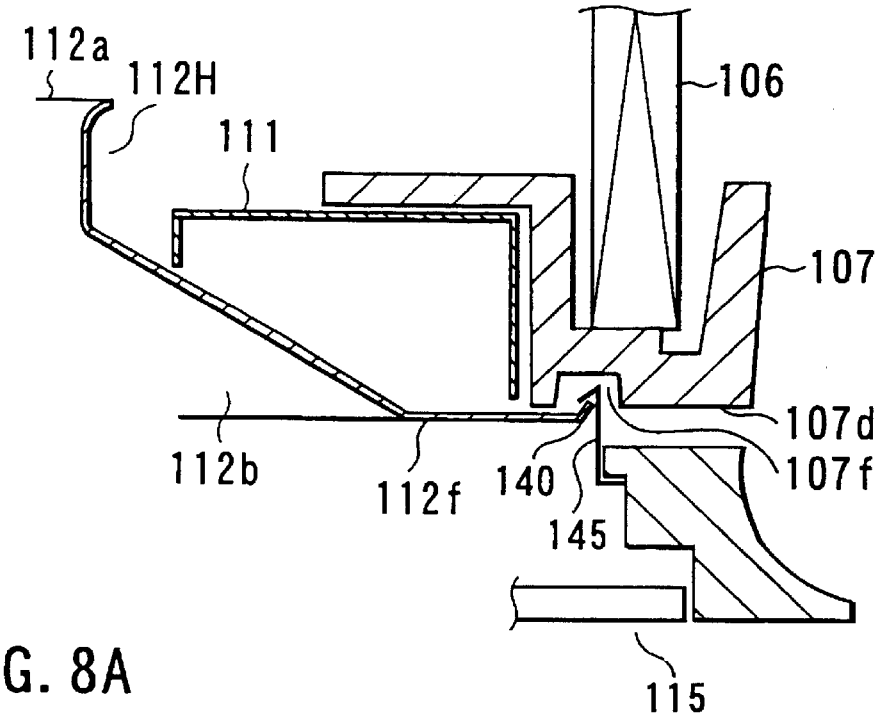
FIGS. 8A and 8B are cross-section drawings that explain the relative relations among the bell-mouth, the electrical parts box, and the drain pan which are built into the same ceiling cassette type air conditioner
Figure 8B:
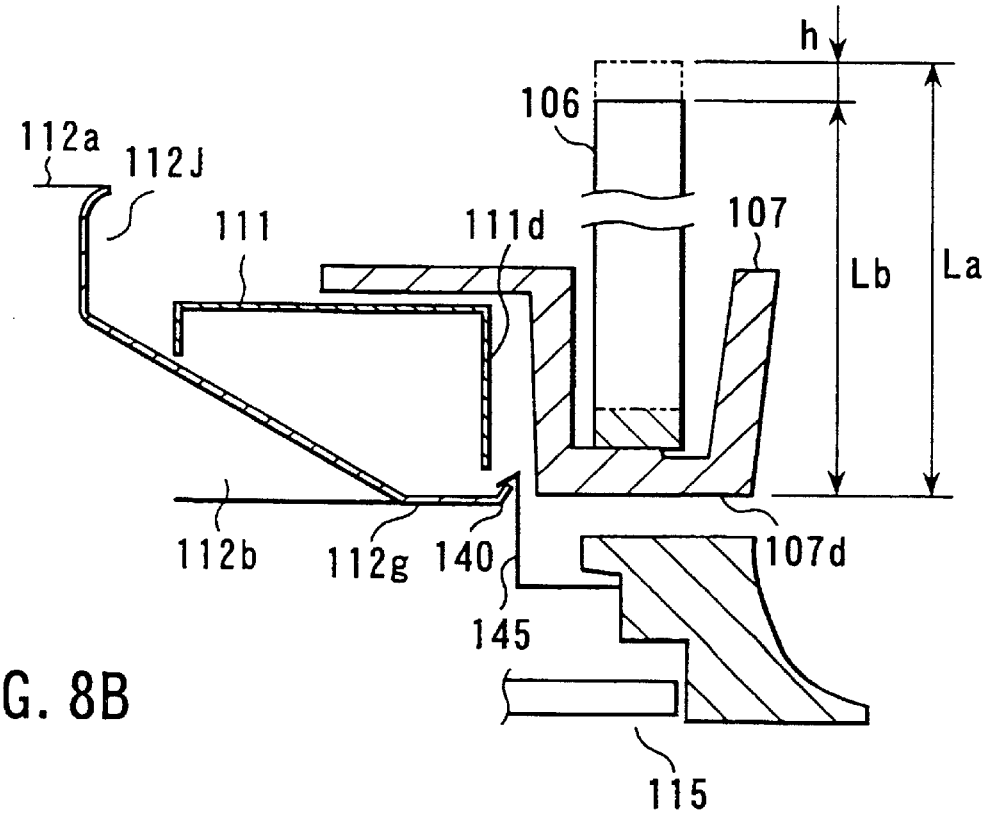

Bell-mouth structures shown in FIGS. 8A and 8B may also be taken. In these drawings the electrical parts E accommodated in the electrical parts box 111 were omitted, but the same mounting explained previously was conducted. Therefore, similar effects can be obtained.

Bell-mouth 112H shown in FIG. 8A is based on the assumption that the periphery of the bottom opening portion 112*b* has an extension portion 112*f* that extends towards the outside beyond the large height dimension sidewall 111*d* of the electrical parts box 111, and characterized by having an integrated hooking portion 140 that is formed by bending the edge upwards at a specified position of the extended portion 112*f.* On the other hand, the decorative panel 115 can be freely mounted to or removed from the enclosure 101, and it is mounted with fixtures that are not illustrated. Actually, the decorative panel 115 is equipped with a suspension device for making temporary mounting, and by hooking this to the specified position, the decorative panel 115 can be temporarily attached, then by using fixtures it can be fixed firmly. Here, to the hooking portion 140 formed at the extension portion 112*f* of the bell-mouth 112H, the temporary suspension device 145 of the decorative panel 115 is hooked and the decorative panel is mounted temporarily, then fixed firmly with fixtures Hitherto, an exclusive receiving metal piece corresponding to the hooking portion 140 was prepared, and at the time of molding the drain pan 107 the aforementioned metal piece was embedded. Thus, the number of parts increased and the molding was troublesome. By adopting the above-mentioned composition, the number of parts can be decreased and the processing trouble can be reduced.

Furthermore, in the composition shown in FIG. 8A, at the bottom portion 107*d* of the drain pan 107, a part of it is concavely formed, and to this concave portion 107*f,* the hooking portion 140 that is made by bending the extension portion 112*f* of the bell-mouth 112H is positioned. The depth dimension of the concave portion 107*f* of the drain pan 107 must be formed deep so that no troubles arise during the mounting and demounting work of the temporary suspension device 145 of the decorative panel 115 against the hooking portion 140.

On the other hand, in the composition shown in FIG. 8B, the edge of the extension portion 112*g* provided for the bell-mouth 112J is more outwards than the large height dimension sidewall 111*d* of the electrical parts box 111, and in addition, it is set so that it will be inside of the heat exchanger receiving portion of the drain pan 107. The hooking portion 140 provided at the edge of the extension portion 112*g* is located between the electrical parts box 111 and the drain pan 107, and the temporary suspension device 145 of the decorative panel is hooked to this.

Therefore, in this case, the concave portion 107 shown in FIG. 8A need not be formed, and the heat exchanger 106 supporting position of the drain pan 107 can be lowered that much.

Actually, the top surface position of the aforementioned heat exchanger 106 will be lowered by dimension h, and the height dimension from the bottom portion 107 of the drain pan to the top surface of the heat exchanger 106 in FIG. 8A was La but in the case of FIG. 8B, Lb will suffice. As a result, the height dimension of the enclosure 101 can be made that much smaller, and the further miniaturization of the unit can be promoted.

Figure 9:
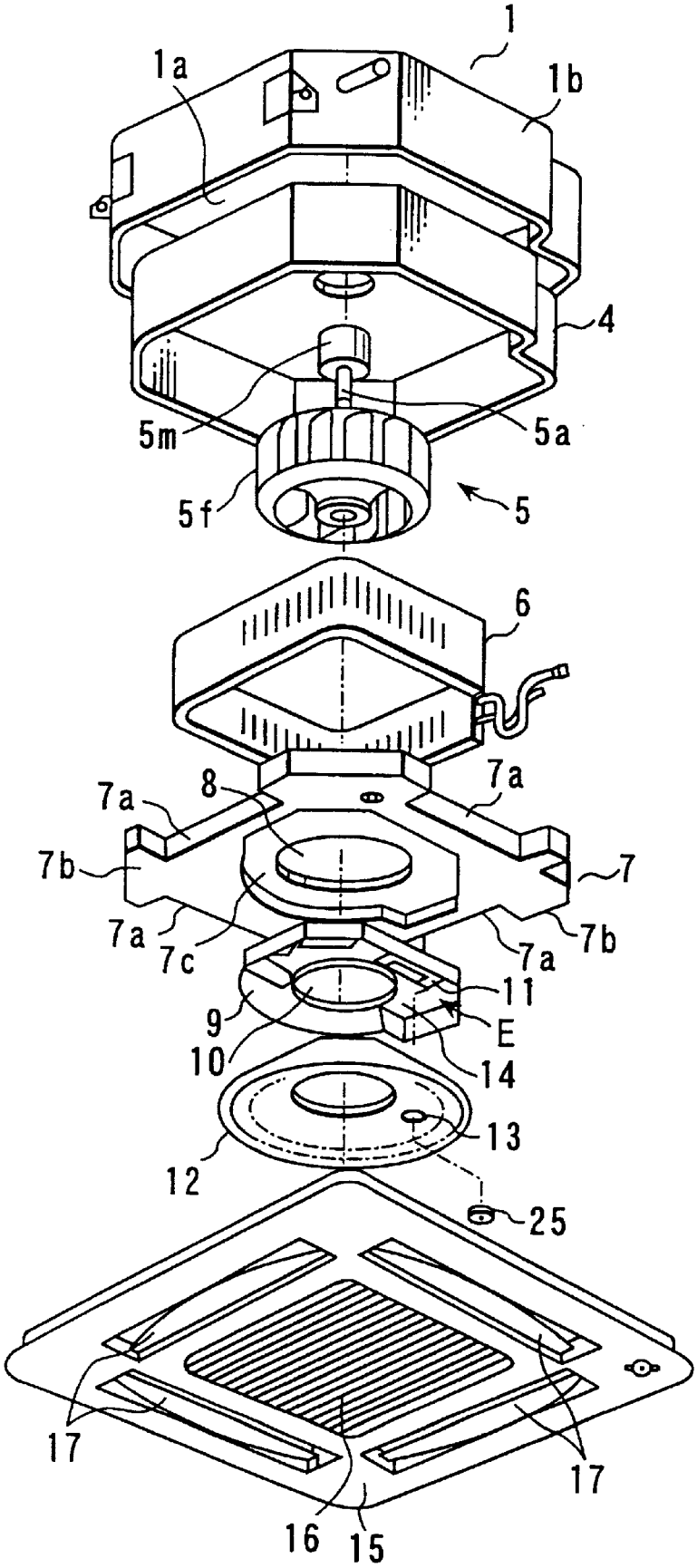
FIG. 9 is a perspective view of a disassembled ceiling cassette type air conditioner related to the second embodiment of the present invention is shown.
Figure 10:
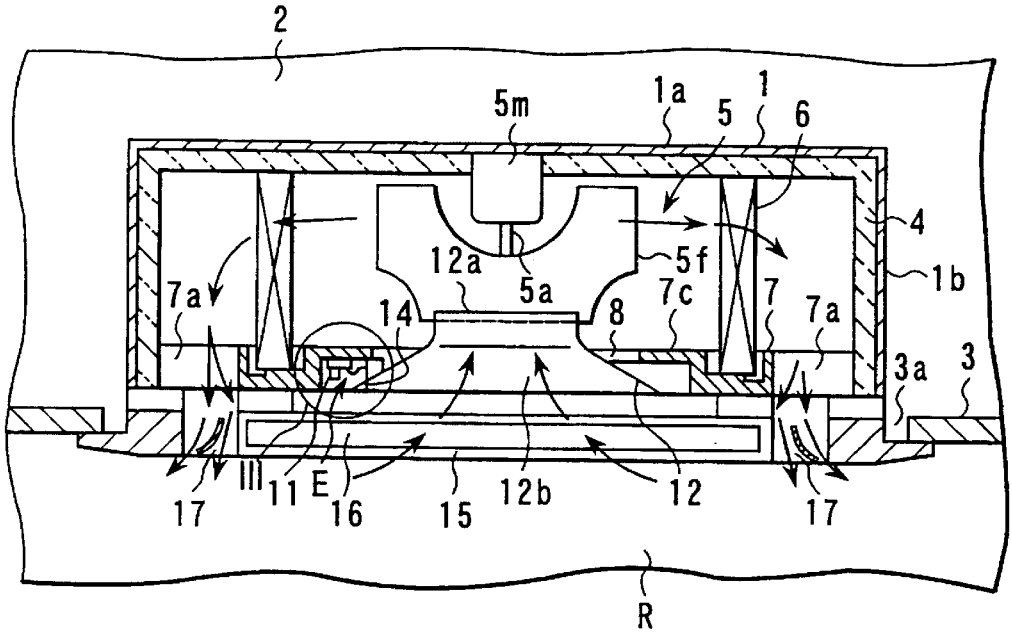
FIG. 10 is a cross-section view of the same ceiling cassette type air conditioner is shown.

FIG. 9 is a perspective drawing that shows a disassembled ceiling cassette type air conditioner, and FIG. 10 is a cross-section view that shows an assembled and operating ceiling cassette type air conditioner.

In the drawing, 1 stands for the enclosure, and this enclosure 1 is a rectangle when seen by the plan view, but the four corners are missing and an octagonal shaped top plate 1*a* is formed. Along each side of this top portion 1*a* an integrated side-wall 1*b* is made, and the bottom of the enclosure 1 is left open.

In the case of the aforementioned enclosure 1, it is supported and fixed to the ceiling by a suitable means, and the bottom opening portion is made to face the opening 3*a* made in the ceiling panel 3. In the inner surface of the top portion la and the side-walls 1*b,* insulating materials are closely attached.

On the inner center portion of the enclosure top portion, fan motor 5*m* that compose the blower is mounted and fixed. The axial direction of this fan motor 5*m* is facing the vertical direction, and to the revolving shaft protruding downwards, the fan 5*f* is engaged. When the aforementioned fan 5*f* is driven and revolved by the fan motor 5*m,* from the lower side of the axial direction air will be sucked in, and blower action that blows air in the circumferential direction will be conducted.

Furthermore, with the blower 5 in the center, heat exchangers 6 are arranged so as to surround it, and they are connected with piping that compose refrigerating cycle with compressors and outdoor heat exchangers arranged to the outdoor units which are not shown.

The above heat exchanger 6 is approximately a rectangle according to the plan view, and it is located in a position where it will receive the air blown by blower fan 5. The heat exchanger 6 is placed on the drain pan 7 that is fitted to the lower opening portion of the enclosure 1 via thermal insulating material 4, and the heat exchanger is supported via thermal insulating material 4 placed between the drain pan 7 and the enclosure top portion 1*a*. In other words, the top surface of the heat exchanger 6 is in close contact with the enclosure top plate 1*a* via thermal insulating materials 4, and the lower side of the heat exchanger 6 is in close contact with the drain pan.

The drain pan 7 is designed so that each side portion 7*a* is formed concavely, and a space exists between it and the enclosure side-wall 1*b*. Thus, practically, only the corner portion 7*b* is engaged with the corner portion of the enclosure side-wall 1*b* via the thermal insulation material 4. Based on this fact, the air that has passed through the heat exchanger 6 is led to the concavely formed portion 7*a* of the drain pan 7.

Furthermore, the drain pan 7 is formed by bending it so that the cross section will be approximately U-shaped at an identical height as the upper edge of the concavely formed portion 7*a* and corner portion 7*b,* and at the bottom portion, the aforementioned heat-exchanger 6 is arranged. At the inside of the bent upper edge, a plate portion 7*c* is installed for the whole periphery, and at the center of the plate portion a round opening 8 having the specified diameter is placed.

To the plate portion 7*c* that composes the drain pan 7, a supporting panel 9 having identical dimensions is engaged, and they are fixed in place by a suitable means. At the center of the supporting panel 9, an opening portion having the same dimensions as the opening portion 8 made in the plate portion 7*c* of the supporting panel 9 is provided, and to this side portion position, the controller 11 and other electrical parts E are mounted.

Via the opening portions of such plate portion 7*c* and supporting panel 9, the upper opening portion 12*a* of the bell-mouth 12 is arranged to face a position close to the shaft center of fan 5*f* of the aforementioned blower 5.

The lower opening portion 12*b* of the bell-mouth 12 possesses a portion bent horizontally along the periphery of the opening, and is in close contact with the bottom surface of the drain pan 7.

The diameter of the upper opening portion 12*a* of the bell-mouth 12 is small, and the diameter of the bottom opening portion 12*b* is large, and a bell-mouth 12 as a whole will have a tapered cross-section. At one portion of this bell-mouth 12, a very small diameter through-hole 13 is made, and as referred to later on, a temperature sensor is inserted through it and supported.

The bottom opening portion of enclosure 1 is blocked by the decorative panel 15 which appears as a rectangle in the plan view. This decorative panel 15 is located in the ceiling panel 3 at a position where it will be exposed to the inside of the room R to be air-conditioned. At the center portion, a rectangle shaped suction inlet 16 is provided, and around this, a plurality of narrow rectangular blowing outlets 17 is opened.

If further explanation is made, the suction inlet 16 of the decorative panel 15 is installed so that it will face the bottom opening portion 12*b* of the bell-mouth 12. Thus, by the action of the blower 5, the room air sucked in from the suction inlet 16 is led to the bottom opening portion 12*b* of the bell-mouth 12, and in addition, the air is guided by the bell-mouth 12, and from its upper opening portion 12*a,* the air is led to the blower fan 5*f.*

On the other hand, each blowing outlet 17 is facing the concavely formed portion 7*a* of the drain pan 7, and the air that passes through the heat exchanger 6 is led to the blowing outlet 17 via the concavely formed portion 7*a,* and from the blowing outlet the air is guided so that it will blow out to the room R to be air conditioned.

Next, a detailed explanation will be given on the supporting structure of the temperature sensor 14.

Figure 11:
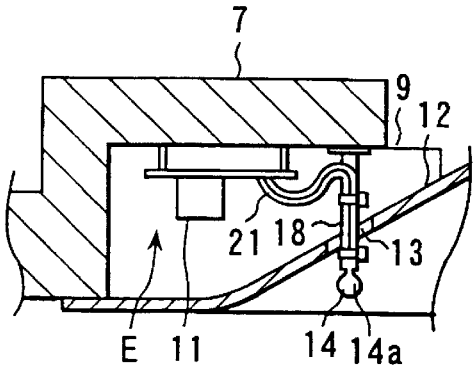
FIG. 11 is an enlarged cross-section view of the temperature-sensor supporting portion built into the same ceiling cassette type air conditioner is shown.
Figure 12:
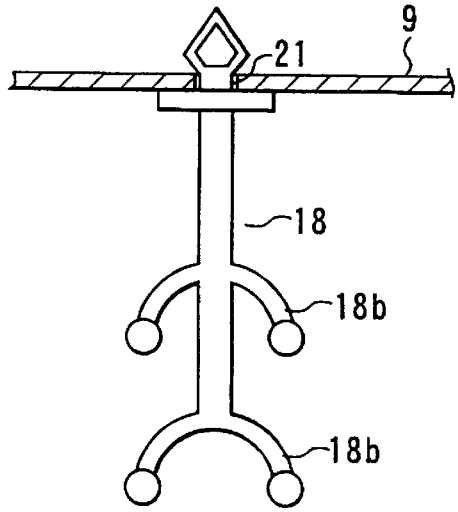
FIG. 12 is an enlarged cross-section view of the sensor-supporting member built into the same ceiling cassette type air conditioner is shown.

FIG. 11 is an enlarged drawing of the supporting structure for temperature sensor 14 that is portion A in FIG. 10, and FIG. 12 is the structural drawing of the sensor supporting member 18 for supporting the temperature sensor 14 of portion A in FIG. 10. The through-hole 13 that is made in the bell-mouth 12 is made at a position close to the controller 11 among the electrical parts E mounted to the supporting panel 9. Immediately above the through-hole portion 13 of the supporting panel 9 a hole portion 21 to which the upper edge of the sensor supporting member 18 is hooked, is made, and the middle portion of the sensor supporting member 18 is inserted into the through-hole 13, and the lower portion of this supporting member is made to protrude from the inner surface of the bell-mouth.

The sensor supporting member 18 is composed of synthetic resin that can be deformed, and at the bottom portion and the middle portion the gripping pieces 18*b*, 18*b* are integrated. Beforehand, the temperature sensor 14 connected to the controller 7 via lead wire 21 is temporarily held in position along the sensor supporting member 18, and by elastic deformation of the gripping pieces 18*b*, 18*b*, the temperature sensor 14 is tightly fixed in place.

Under such a state, the upper edge of the sensor-supporting member 18 is hooked to the hole portion 21 of the supporting panel and supported in a hanging state together with the temperature sensor 14. Subsequently, the bell-mouth 12 is mounted to the specified position.

In an assembled state, together with the sensor supporting member 18, the temperature sensor 14 is inserted into the through-hole portion 13, and the lower end portion which is the thermally sensitive portion 14*a* is made to protrude into the inside of the bell-mouth 12, and held in that position. Since the controller 11 is arranged near the position of the through-hole 13, the total length of the lead wire 21 that electrically connects the temperature sensor 14 which is inserted in the through-hole portion 13, and the controller 11 of the electrical parts E, can be made very short.

This is a ceiling cassette type air conditioner to which the temperature sensor 14 is mounted in the manner, and by driving the blower 5 at the same time the operation of the refrigerating cycle in the heat exchanger 6 is started, the air of the room R to be air conditioned will be sucked in from the suction inlet 16 of the decorative panel 15, guided by the bell-mouth 12, and led to the blower 5, where it is then blown out to the heat exchanger 6.

The heat exchange is conducted at the time the air passes through the heat exchanger 6. Afterwards, it reaches the blowing outlet 17 via the concavely formed portion 7*a* of the drain pan 7, and further blown to the room R to be air conditioned, and thereby conducts air conditioning. The drain pan 7 receives the drain generated together with the heat exchange action of the heat exchanger 6, and after collecting the drain once, it is released outdoors through the drain hose which is not illustrated.

Owing to the mounting position selected, the temperature sensor 14 detects the room temperature by coming into contact with the air of the room to be air conditioned when it is sucked into enclosure 1 by the bell-mouth 12. The detection signals are sent to the controller 11 via the lead wire from the temperature sensor 14. This controller 11 stores the detected room temperature and signals sent from other detection means in order to detect other conditions, then conducts calculation and sends out control signals to each component part so that the pre-set operating conditions can be satisfied.

In the present invention, by a simple composition of obtaining a small diameter through-hole portion 13 by boring a hole in part of the bell-mouth 12, the temperature sensor 14 is mounted to the optimum position, and naturally, the detection accuracy is maintained, and it is not necessary to extend the lead wire that connects the controller 11 over a long distance. Therefore, the mounting workability is improved and it contributes to reducing the cost.

Even at the time of maintenance work which requires the removal of the bell-mouth 12, it is not necessary to remove the sensor supporting member 18 and the temperature sensor 14. In other words, if the fixtures of the bell-mouth 12 are removed, the sensor supporting member 18 and the temperature sensor 14 can be left in the same state, and merely by moving the bell-mouth 12 downwards while maintaining the horizontality, the bell-mouth 12 can be removed. Since the sensor supporting member 18 and temperature sensor 14 are hung vertically, they will slip out without being caught by the through-hole portion 13 of the bell-mouth 12, and the bell-mouth can be removed without any trouble.

After the maintenance work is completed, and the bell-mouth 12 is to be mounted to the specified position again, since the locations and the positions of the sensor supporting member 18 and the temperature sensor 14 remain the same, it will suffice if the through-hole portion 13 of the bell-mouth 12 is made to face the supporting member and the sensor, and the bell-mouth is raised while maintaining horizontality, then after inserting the supporting member and sensor into the through-hole, mounting and fixing the bell-mouth in the specified position.

In other words, maintenance work can be conducted by a simple operation of inserting the temperature sensor 14 and the sensor supporting member 18 together in the through hole 13 made in the bell-mouth 12. Since this work is made easy, improvement of workability can be obtained.

Furthermore, as raw material of the bell-mouth 12 itself, normally, synthetic resin is used with the objective of making the unit light, but in this case a very thin metal material will be used. In other words, the electrical parts E are arranged close to the bell-mouth 12, and among these parts, the controller 11 having large heat generation in particular is included. Owing to the available arrangement space, the controller 11 cannot be accommodated in the box, and it is exposed against the bell-mouth 12.

After long operation, the temperature of the controller 11 will become high, and since there is no effective means to cool it, it will release heat to the surroundings and give thermal influence. If the bell-mouth is made of synthetic resin, at the time the controller 11 is overheat-ed, there is fear of partial deformation by the heat. However, as described above, if the bell-mouth is made of metal material, even if the controller 11 which is arranged nearby is overheated, it will not be influenced by the heat.

Figure 13:
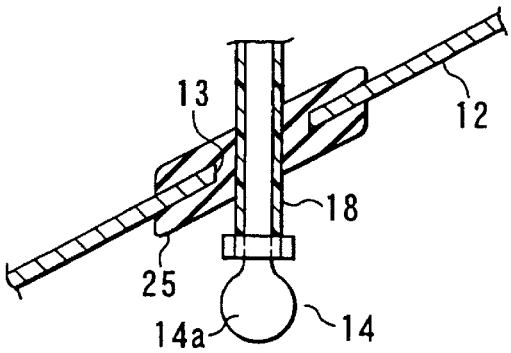
FIG. 13 is a cross-section view of a sealing member fitted into the through-hole portion built into the same ceiling cassette air conditioner is shown.

As shown in FIG. 13, in order to fill the gap between the temperature sensor 14 via the sensor supporting member 18, and the through-hole 13, sealing member 25 consisting of elastic material may be used in-between.

In this case, by making the sealing member 25 into a structure split in two, it is possible to mount the sealing member 25 in a state in which the sensor supporting member 18 gripping the temperature sensor 14 is inserted in the through-hole 13 of the bell-mouth 12, and in accordance with the necessity, it is possible to remove the sealing member 25 while maintaining the state of the temperature sensor 14 as it is.

The gap between the temperature sensor 14 via the sensor supporting member 18, and the through-hole 13, is filled with the sealing member 25. Therefore, the air heat-ed by the electrical parts E which become the heat source such as the controller 11 and show temperature rise will not pass through the gap that exist between the through-hole 13, and it will not come into contact with the heat sensing portion 14*a* of the temperature sensor 14, so the detection accuracy of the temperature sensor 14 can be secured.

Figure 14:
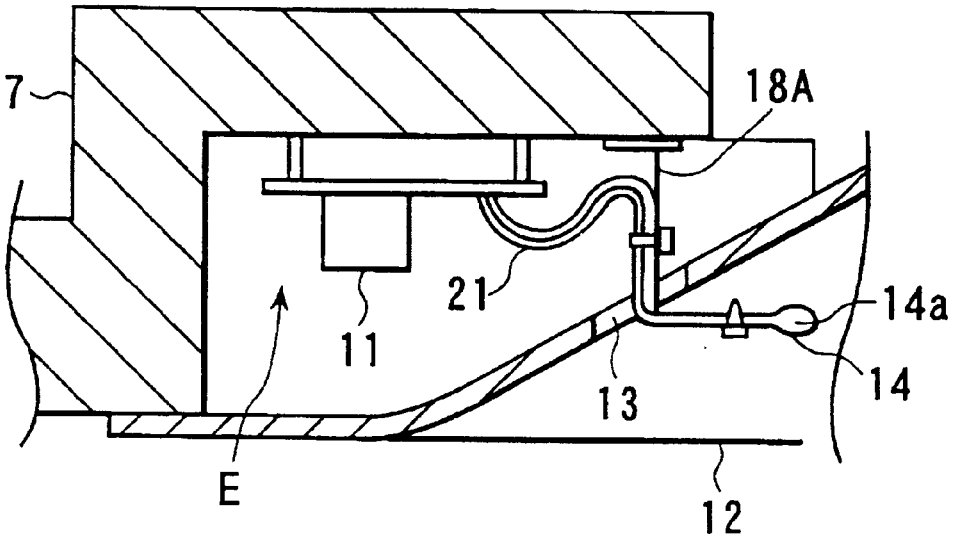
FIG. 14 is a cross-section view that shows an example of No. 1 modified shape of the same temperature-sensor mounting portion.

Furthermore, in the aforementioned embodiments, the sensor-supporting member 18 was formed in a vertical shape, but it need not be restricted to this, and as shown in FIG. 14, a sensor supporting member 18A that is bent in the horizontal direction at a position where it protrudes through the through-hole, may also be used.

Because of the above, the mounting direction of the temperature sensor 14 becomes horizontal, and the mounting position versus the bell-mouth 12 of the heat sensing portion 14*a* can be changed. In other words, the adjustment of the mounting position of the temperature sensor 14 need not be restricted to the vertical direction, and the degree of freedom for selecting the optimum position increases.

Figure 15:
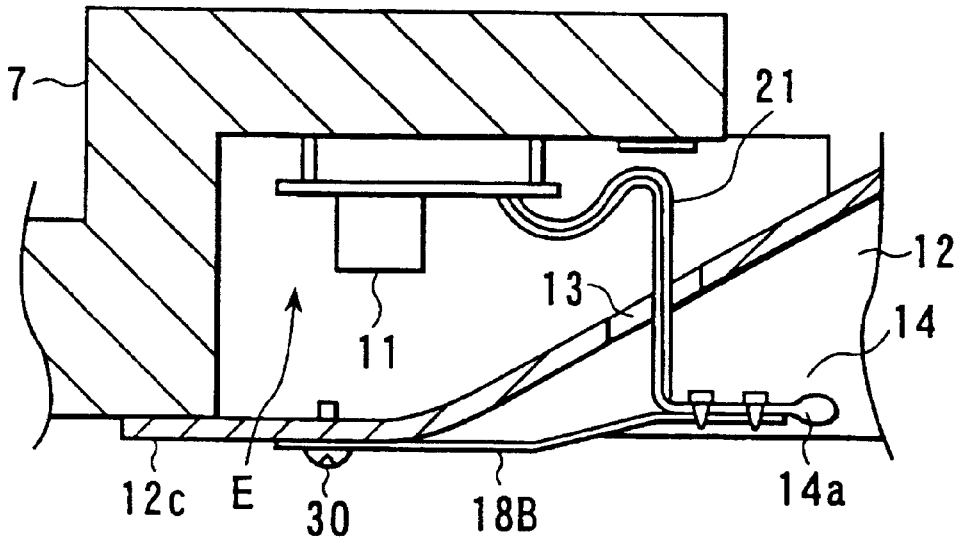
FIG. 15 is a cross-section view that shows an example of No. 2 modified shape of the same temperature-sensor mounting portion.
Figure 16A:
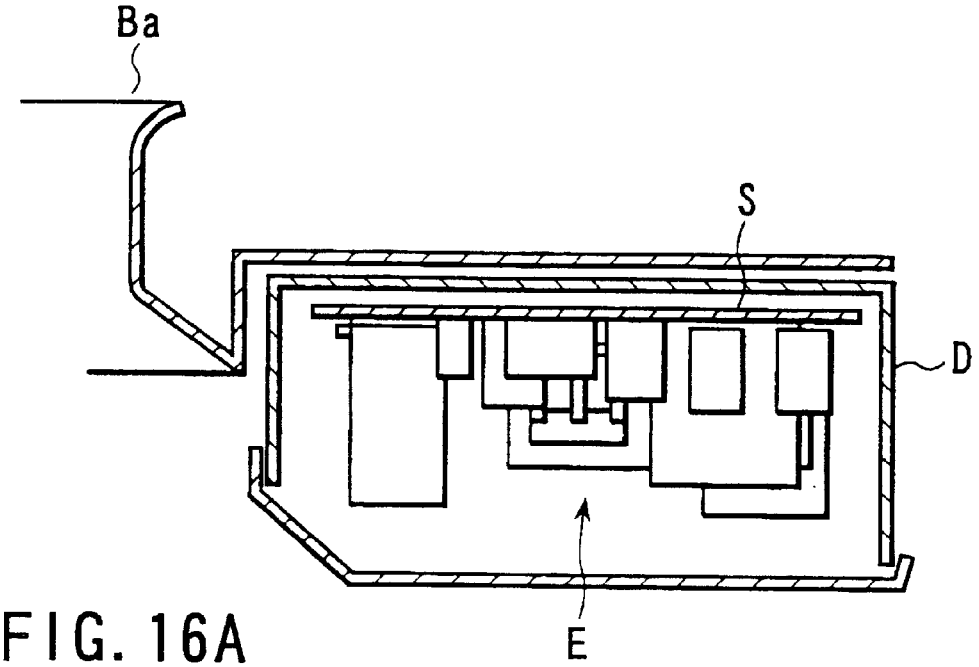
FIG. 16A PRIOR ART
FIGS. 16A and 16B are cross-section drawings that explain the relative relation between the conventional bell-mouth and the electrical parts box which have mutually different cross-sectional shapes.
Figure 16B:
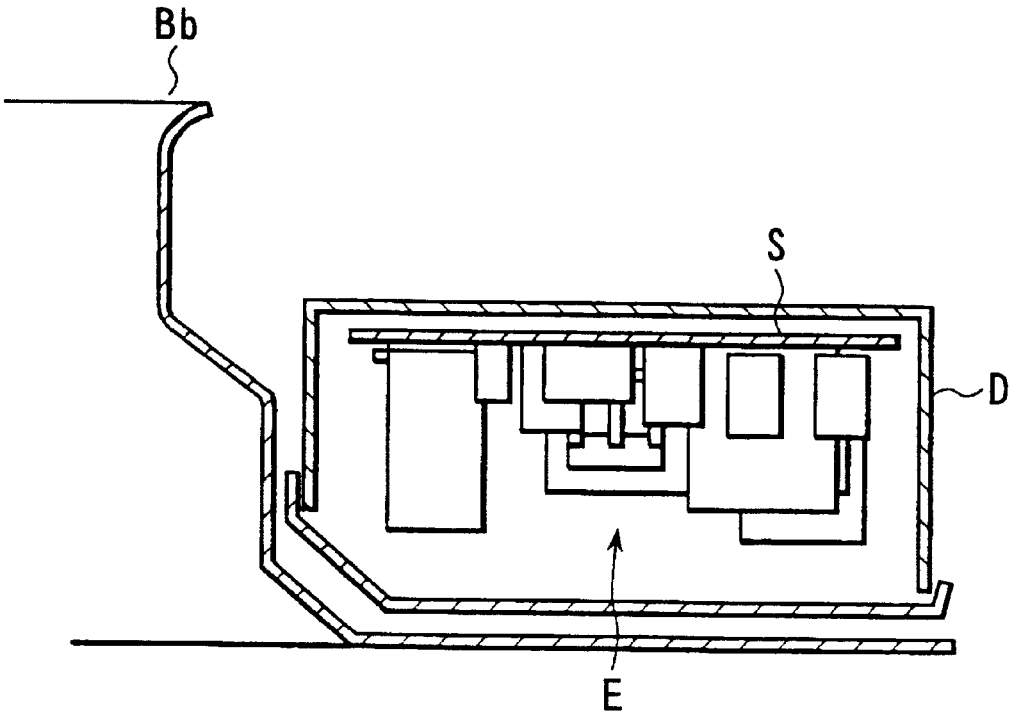
FIG. 16B PRIOR ART

From the same objective, as shown in FIG. 15, the sensor supporting member 18B may be mounted and fixed via the fixtures 30 to the flange portion 12*c* formed on the periphery of the bottom opening portion 12*b* of the bell-mouth 12. The temperature sensor 14 will face the horizontal direction according to the position of the sensor supporting member 18B, and only the lead wire 21 that is to be connected is passed through the through-hole 13. In this case, it is possible to extend the position of temperature sensor 14 to the shaft center position of the bell-mouth 12, and the degree of freedom for selecting the optimum position will increase all the more.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A ceiling cassette type air conditioner, comprising:

a housing constructed and arranged to be fitted to a room ceiling panel and having a bottom opening;

a heat exchanger arranged in the housing;

a drain pan provided in the housing;

a blower provided in the housing;

a bell-mouth provided in the housing and having a bottom opening and an outer circumferential surface;

an electrical parts box provided in the housing, constructed and arranged to accommodate electrical parts;

a control board provided in the electrical parts box;

electrical components mounted on the control board; and a decorative panel closing the bottom opening of the housing, the decorative panel having an inlet port opposing the bottom opening of the bell-mouth and having outlet ports surrounding the inlet port;

wherein the electrical parts box is arranged near that side of the bell-mouth at which secondary air flows, the electrical parts being arranged on the control board such that those electrical parts which are located near the outer circumferential surface of the bell-mouth are less tall than other of the electrical parts.

2. A ceiling cassette type air conditioner according to claim 1, wherein electrical parts that are taller than other of the electrical parts are arranged more remotely from the periphery of the bell-mouth.

3. A ceiling cassette type air conditioner according to claim 2 wherein the bell-mouth is made of flame retardant synthetic resin or metal.

4. A ceiling cassette type air conditioner according to claim 3, wherein the bell-mouth has a peripheral portion formed along the bottom opening portion thereof that extends beyond the peripheral edge of the electrical parts box, and the extended portion is in close contact with the drain pan.

5. A ceiling cassette type air conditioner according to claim 2, wherein the decorative panel has a hooking portion for hooking to an edge portion of the bell-mouth.

6. A ceiling cassette type air conditioner according to claim 1 wherein the bell-mouth is made of flame retardant synthetic resin or metal.

7. A ceiling cassette type air conditioner according to claim 1, wherein the decorative panel has a hooking portion for hooking to an edge portion of the bell-mouth.

8. A ceiling cassette type air conditioner, comprising:

a housing constructed and arranged to be provided in a loft and having a bottom opening;

a blower provided at a central portion of the housing for receiving air flowing along an axis and blowing the air along a circumference;

a heat exchanger arranged at an outlet side of the blower;

a bell-mouth having an inlet port, a bottom opening and a top opening opposing an inlet side of the blower and coaxial with the axis of the blower; and a decorative panel exposed to a room at the ceiling thereof, closing the bottom opening of the housing, having an inlet port opposing the bottom opening of the bell-mouth and having outlet ports surrounding the inlet port;

electrical parts including a controller arranged above the bell-mouth, the bell mouth having a through hole near the electrical parts; and a temperature sensor for detecting a temperature in a room, the temperature sensor being inserted in the through hole and extending into the inlet port of the bell mouth and being electrically connected to the controller.

9. A ceiling cassette type air conditioner according to claim 8 further comprising:

a supporting member supporting the temperature sensor, the supporting member being inserted vertically through the through hole.

10. A ceiling cassette type air conditioner according to claim 9, wherein the bell-mouth is made of metal.

11. A ceiling cassette type air conditioner according to claim 8, wherein the bell-mouth is made of metal.

12. A ceiling cassette type air conditioner according to claim 8 further comprising:

an elastic sealing material embedded in the gap between the through hole and the temperature sensor, the sealing material being constructed and arranged so that it can be freely attached and detached.

* * * * *